US010670328B2

(12) United States Patent
Park et al.

(10) Patent No.: US 10,670,328 B2
(45) Date of Patent: Jun. 2, 2020

(54) REFRIGERATOR AND METHOD FOR CONTROLLING THE SAME

(71) Applicant: LG ELECTRONICS INC., Seoul (KR)

(72) Inventors: Kunkook Park, Seoul (KR); Joongkeun Lee, Seoul (KR); Choye Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 162 days.

(21) Appl. No.: 15/002,109

(22) Filed: Jan. 20, 2016

(65) Prior Publication Data

US 2016/0209109 A1 Jul. 21, 2016

(30) Foreign Application Priority Data

Jan. 20, 2015 (KR) ..... 10-2015-0009302

(51) Int. Cl.

| | |
|---|---|
| ***F25D 29/00*** | (2006.01) |
| ***F25D 27/00*** | (2006.01) |
| ***H04N 7/18*** | (2006.01) |
| ***H04N 5/225*** | (2006.01) |
| ***G06T 7/00*** | (2017.01) |

(52) U.S. Cl.

CPC ..... *F25D 27/005* (2013.01); *F25D 29/003* (2013.01); *F25D 29/005* (2013.01)

(58) Field of Classification Search

CPC ..... F25D 27/005; F25D 29/003; F25D 29/005
USPC ..... 348/148
See application file for complete search history.

(56) References Cited

U.S. PATENT DOCUMENTS

| | | | | |
|---|---|---|---|---|
| 6,848,264 | B2 * | 2/2005 | Lee | F25D 17/045 62/178 |
| 9,423,169 | B2 * | 8/2016 | Kim | F25D 21/02 |
| 2007/0220907 | A1 * | 9/2007 | Ehlers | F25B 49/005 62/126 |
| 2008/0264074 | A1 * | 10/2008 | Chase | F25C 5/187 62/66 |
| 2013/0015753 | A1 * | 1/2013 | Son | F25D 29/00 312/405 |
| 2013/0223279 | A1 | 8/2013 | Tinnakornsrisuphap et al. | |
| 2014/0111118 | A1 * | 4/2014 | Kendall | H05B 37/0218 315/362 |
| 2014/0148969 | A1 * | 5/2014 | Graziano | H04L 67/125 700/300 |

(Continued)

FOREIGN PATENT DOCUMENTS

| | | | |
|---|---|---|---|
| JP | 2010097390 | A | 4/2010 |
| JP | 2010261620 | A | 11/2010 |

(Continued)

*Primary Examiner* — Susan E. Hodges
(74) *Attorney, Agent, or Firm* — Dentons US LLP

(57) ABSTRACT

A refrigerator having a cabinet with a storage compartment for storing food therein, a sensor mounted in the cabinet to sense information of an interior of the refrigerator, a first converting unit for converting the information sensed by the sensor into data to be transmitted through a light source, a light source for emitting light so as to flicker according to the data of the first converting unit, a camera for successively capturing an image of the light source, and a second converting unit for converting information related to flickering of the light source captured by the camera into data related to the sensor.

8 Claims, 4 Drawing Sheets

(56) References Cited

U.S. PATENT DOCUMENTS

2014/0320647 A1* 10/2014 Seo ..... F25D 29/00
348/143
2014/0368103 A1* 12/2014 Son ..... F25D 29/00
312/401
2015/0059374 A1* 3/2015 Hebel ..... F25D 29/00
62/125
2015/0327304 A1* 11/2015 Tinnakornsrisuphap .....
H04L 41/0809
709/227
2016/0138859 A1* 5/2016 Stimpfig ..... F25D 27/005
62/125
2016/0182864 A1* 6/2016 Izawa ..... H04N 5/44

FOREIGN PATENT DOCUMENTS

WO 2014/142118 A1 9/2014
WO 2014/142119 A1 9/2014
WO 2014/142120 A1 9/2014

* cited by examiner

REFRIGERATOR AND METHOD FOR CONTROLLING THE SAME

CROSS-REFERENCE TO RELATED APPLICATION(S)

This application claims priority under 35 U.S.C. § 119 and 35 U.S.C. § 365 the benefit of Korean Patent Application No. 10-2015-0009302, filed on Jan. 20, 2015, which is hereby incorporated by reference.

BACKGROUND

Field of the Disclosure

The present invention relates to a refrigerator and a method for controlling the same and, more particularly, to a refrigerator and a method for controlling the same, which are capable of transmitting information sensed by a sensor to a camera through a light source.

Discussion

In general, a refrigerator is an apparatus for storing foods at a low temperature by generating cool air using a cooling cycle. The only function of a conventional refrigerator is to store foods at a low temperature. However, the development of refrigerators having extra features in addition to food storage has recently been increasingly demanded.

Refrigerators may be equipped with various types of sensors. However, there is a problem in that many different wires must be mounted in a refrigerator in order to transmit the information measured by the sensors.

SUMMARY

Accordingly, the present disclosure is directed to a refrigerator and a method for controlling the same that substantially obviate one or more problems due to limitations and disadvantages of the related art.

According to an embodiment of the present disclosure, a refrigerator includes a cabinet having a storage compartment, a sensor provided in the cabinet to sense information about an interior of the refrigerator, a first converting unit to convert the information sensed by the sensor into data, a light source to emit light so as to flicker according to the data of the first converting unit, a camera to successively capture an image of the light source, and a second converting unit to convert information related to the flickering light source captured by the camera into data related to the sensor.

According to another embodiment of the present disclosure, a method for controlling a refrigerator includes determining whether a door is closed using a sensor, wherein upon determining that the door is closed, driving a light source to flicker using a driving unit, capturing an image of the flickering light source using a camera, and converting the image successively captured by the camera into information related to a sensor using a converting unit.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to the preferred embodiments of the present disclosure, examples of which are illustrated in the accompanying drawings.

Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
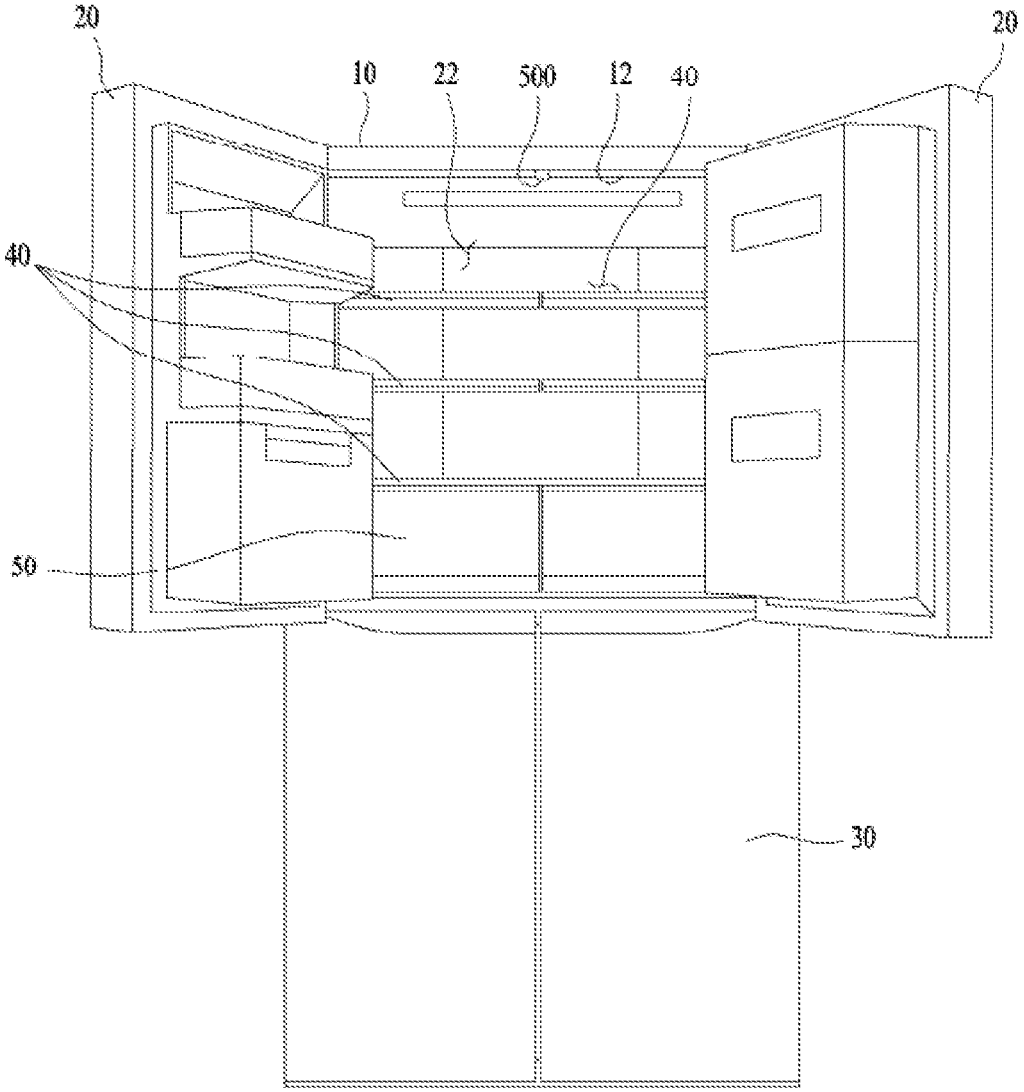
FIG. 1 is a front view of a refrigerator according to an embodiment of the present disclosure when doors are open.

FIG. 1 is a front view of a refrigerator according to an embodiment of the present disclosure when doors are open.

A refrigerator according to the embodiment may be applied to a top mount-type refrigerator, which is generally partitioned up and down into food storage compartments including a freezing compartment and a refrigerating compartment (e.g., the freezing compartment is provided above the refrigerating compartment), or to a side by side-type refrigerator, which is partitioned left and right into a freezing compartment and a refrigerating compartment, or vice-versa.

However, for explanatory convenience, the embodiment will be explained with reference to a bottom freezer-type refrigerator, which is partitioned up and down into a refrigerating compartment and a freezing compartment (i.e. the freezing compartment is provided below the refrigerating compartment).

The cabinet of the refrigerator includes an outer case 10 of the refrigerator and an inner case 12 providing a storage compartment 22 for storing food or items therein. A predetermined space may be formed between the outer case 10 and the inner case 12, in which a passage for the circulation of cool air may be formed. An insulator may be disposed between the outer case 10 and the inner case 12 to keep or maintain the interior of the compartment 22 at a lower temperature than the atmosphere temperature.

A refrigerant cycle device for generating cool air by circulating the refrigerant is mounted in a machine area (not shown) formed in the space between outer case 10 and inner case 12. Food or items stored in the refrigerator are kept fresh by maintaining the interior of the refrigerator at a low temperature using the refrigerant cycle device. The refrigerant cycle device includes a compressor for compressing refrigerant, and an evaporator for phase-converting refrigerant liquid into refrigerant gas to perform heat exchange with the atmosphere.

The refrigerator includes doors for opening and closing the storage compartments. The doors may include a freezing compartment door 30 and a refrigerating compartment door 20. The doors 20 and 30 may be swingably mounted or hinged to the cabinet of the refrigerator by means of hinges connecting edges of the doors to the cabinet. It is understood that there may be a plurality of freezing compartment door 30 and/or refrigerating compartment door 20. For example, as shown in FIG. 1, a pair of refrigerating compartment doors 20 and a pair of freezing compartment doors 30 may be mounted so as to be opened forward about respective side edges of the cabinet.

A foaming agent may be disposed between outer case 10 and inner case 12 to insulate storage compartment 22 from the outside.

The storage compartment 22 provides a space that is insulated from the outside by inner case 12 and door 20. If door 20 is closed and seals storage compartment 22, storage compartment 22 may provide a space that is isolated and insulated from the outside. In other words, storage compartment 22 may be a space that is isolated from the outside by an insulating wall formed by door 20 and an insulating wall formed by cases 10 and 12.

The cool air supplied from the machine area may flow throughout storage compartment 22, thereby keeping the food or items stored in storage compartment 22 at a low temperature, e.g., a sufficiently low temperature.

A shelf 40, on which food or items may be placed, may be provided in storage compartment 22. It is understood that there may be a plurality of shelf 40 (shelves 40). For example, as shown in FIG. 1, shelves 40 may extend in a horizontal direction, and may partition the interior of storage compartment 22 in a vertical direction.

A drawer 50, which can be pushed backward and pulled forward, may be provided in storage compartment 22. Food and other items can be contained and stored in drawer 50. In storage compartment 22, two drawers 50 may be arranged on the left and right, respectively; however, the invention is not limited thereto. For example, if a user opens the left door of storage compartment 22, the user may have access to the left drawer, and if a user opens the right door of storage compartment 22, the user may have access to the right drawer.

The interior of storage compartment 22 may also be partitioned into a plurality of food storage spaces, including the spaces provided above shelves 40, the spaces provided by drawers 50, etc.

The cool air supplied to one storage compartment may freely flow to the partitioned spaces in the storage compartment, but may be prevented from flowing to another storage compartment. That is, the cool air located above shelves 40 may flow to the spaces provided by drawers 50.

The refrigerator according to an embodiment of the present disclosure may further include a camera 500 for capturing an image of the interior of storage compartment 22. The camera 500 may be provided at a fixed position so as to capture an image of the same region (e.g., a still image).

In particular, camera 500 may be mounted in the upper wall of inner case 12 and face downwards, thereby capturing an image of the food or items stored in storage compartment 22. The captured image may be the same as the view that is seen when a user looks down into the interior of storage compartment 22, i.e., what the user sees when he or she actually uses the refrigerator.

More particularly, camera 500 may be provided above the interior of the drawer when the drawer is open, or fully opened. Therefore, the captured image may be similar to the view that is seen when a user looks down into the interior of the drawer.

Although not illustrated in FIG. 1, a light source to illuminate the interior of storage compartment 22 is mounted so that a user can look into storage compartment 22 when he or she opens door 20. A plurality of light sources may be mounted in several positions, so that there is no dark place in the storage compartment 22.

Figure 2:
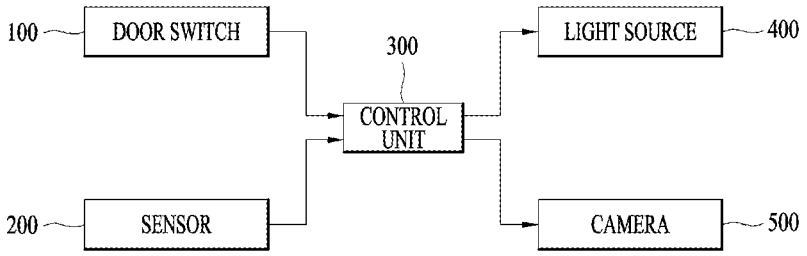
FIG. 2 is a control block diagram.

FIG. 2 is a control block diagram of the refrigerator according to an embodiment of the present disclosure.

Referring to FIG. 2, the refrigerator may further include a door switch 100 to sense when the door 20 is open. The door switch 100 may sense when a user swings door 20 to access the storage compartment 22 and when door 20 of storage compartment 22 is open. The door switch 100 is provided in the cabinet, and may sense when door 20 of storage compartment 22 is open based on when door 20 is pressing door switch 100.

The refrigerator according to an embodiment of the present disclosure may further include a sensor 200 that is provided in the cabinet to sense information related to the internal state of the refrigerator. The sensor 200 may include any one of a temperature sensor to detect a temperature, a humidity sensor to detect humidity, an illuminance sensor to detect the intensity of illumination, and a decomposition sensor to detect the extent to which food has spoiled.

Various types of sensors may be provided in the refrigerator. The sensors may function to collect information related to the internal state of the refrigerator in order to provide the information to a user, and may also function to transmit the information to a control unit 300 of the refrigerator so that the control unit 300 can use the information to control the operation of the refrigerator.

The control unit 300 may function to operate the refrigerator based on the information transmitted from the various types of sensors 200.

For example, when temperature sensor 200 or humidity sensor 200 senses that the temperature or humidity in storage compartment 22 has exceeded a predetermined range and transmits this information to control unit 300, control unit 300 may provide the information to a user through a display or sound device. The control unit 300 may also change the temperature or humidity in storage compartment 22 by driving the compressor or the like.

The control unit 300 may also drive light source 400 based on the information transmitted from door switch 100. For example, when door switch 100 senses that door 20 is open, control unit 300 may turn the light source 400 on.

Further, control unit 300 may drive camera 500 so that camera 500 may capture an image. For example, when door switch 100 senses that door 20 is open, control unit 300 may control camera 500 to capture an image. On the other hand, control unit 300 may control camera 500 to capture an image when door switch 100 senses that door 20 is closed.

Although control unit 300 may not be connected to sensor 200 or to light source 400 in a wired manner, it may still be considered the component for controlling the overall operation of the refrigerator.

The control unit 300 may include a first converting unit to convert information measured by the sensor into data and a second converting unit to convert an image captured by the camera into data, which will be described more below.

Figure 3:
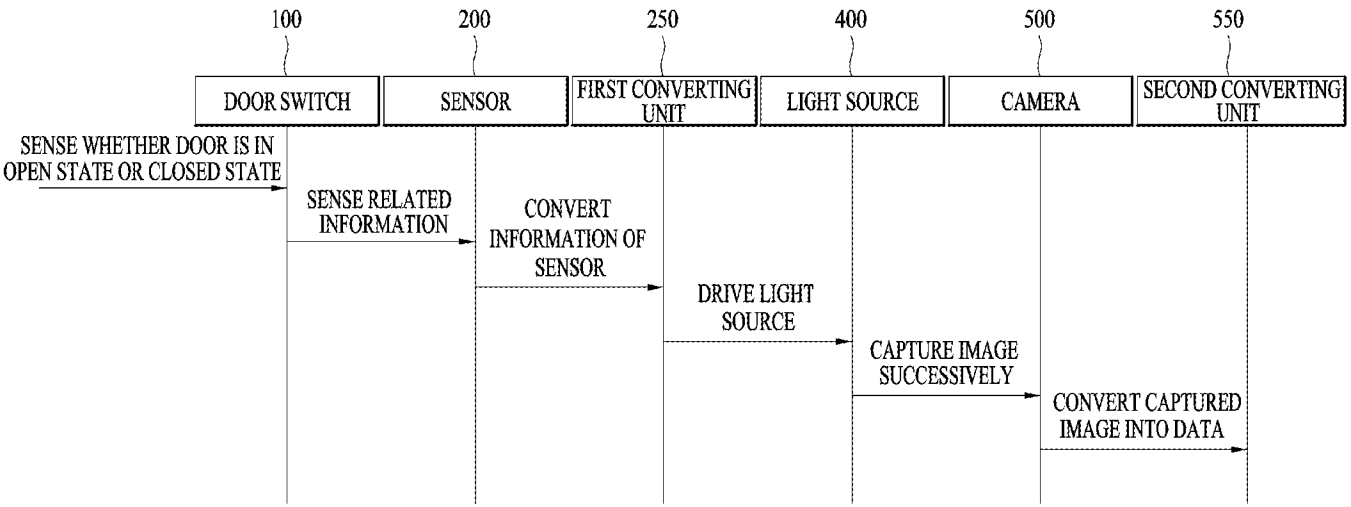
FIG. 3 is a control flow chart diagram.

FIG. 3 is a control flow chart diagram of the refrigerator according to an embodiment of the present disclosure.

First, referring to FIG. 3, door switch 100 senses whether door 20 of storage compartment 22 is open or closed.

For example, when sensor 200 is a camera for capturing an image of the interior of the storage compartment, information can only be obtained from sensor 200 when the door switch 100 senses that the door 20 is open. Otherwise, a problem may occur whereby door 20 covers a portion of the storage compartment 22 whose image is to be captured by the camera.

Meanwhile, when sensor 200 is a temperature sensor or a humidity sensor, information can only be obtained from sensor 200 when door switch 100 senses that door 20 is closed. Because the information measured by sensor 200 while door 20 of storage compartment 22 is open is affected by the temperature and humidity outside of the cabinet, it may be difficult to get useful information related to the storage compartment 22. Therefore, depending on the type of the sensor and the sensing result of door switch 100 about the opening or closing of door 20, the time at which it is possible to get information from the sensor 200 may be different.

The information measured by the sensor 200 may be converted into data, which is to be transmitted through the light source, by a first converting unit 250. The information from the sensor 200 may be a specific value or a specific image, and first converting unit 250 may convert the related information into a digital signal.

The light source 400 may be configured to turn on and off alternately. Therefore, the information from sensor 200 may be converted into data that is to be transmitted through light source 400.

The light source 400 may flicker according to the data converted by first converting unit 250. The time interval of the flickering of light source 400 may be different. Since the extent to which light source 400 flickers is based on the data into which the information measured by sensor 200 is converted by first converting unit 250, it may vary.

Particularly, only while the door switch 100 senses that the door 20 is closed, light source 400 is driven to transmit the information. This is because it may be inconvenient for a user to use storage compartment 22 if light source 400 flickers to transmit the information without regard to the user's intention.

Sensor 200, first converting unit 250 and light source 400 may be connected to each other via wires, or be wirelessly connected. When connected to each other via wires, the information from sensor 200 may be transmitted to first converting unit 250 through the wires, and may be further transmitted to light source 400 through the wires. Also, because sensor 200, first converting unit 250, and light source 400 may be arranged adjacent to each other, there is no problem of decrease in space of the storage compartment.

The camera 500 may capture an image including light source 400. For example, when camera 500 is provided in the upper portion of inner case 12 and faces downwards, light source 400 may appear in the image captured by camera 500.

Particularly, the image capture by camera 500 may be performed only when door switch 100 senses that door 20 is closed. The user is not affected by the flickering of light source 400 when door 20 is closed, but when the light source 400 flickers regardless of the user's intention when the door 20 is open, the user may be inconvenienced.

Therefore, camera 500 may successively capture an image of the light source 400 only while door switch 100 senses that door 20 is closed.

By comparing the images successively captured by camera 500, it is possible to get information related to the successive flickering of light source 400.

The second converting unit 550 may be convert the information related to the flickering of light source 400, whose images are successively captured by camera 500, into sensor data. The second converting unit 550 may compare the images successively captured by camera 500 in temporal order, and may receive information related to the operation of light source 400.

The information measured by sensor 200 may be transmitted to other components, e.g., the control unit, in the form of the data converted by second converting unit 550 so as to be used by the user or used to control the operation of the refrigerator.

Particularly, camera 500 and second converting unit 550 may be connected to each other via wires. Therefore, the image captured by camera 500 may be transmitted to second converting unit 550. The second converting unit 550 may also function as a camera driving unit to generate a command to drive camera 500 to capture an image.

As described above, sensor 200, first converting unit 250, and light source 400 may be connected to each other via wires, and camera 500 and second converting unit 550 may be connected to each other via wires. In contrast, the camera 500 and light source 400 may not be connected to each other via wires.

In general, camera 500 and light source 400 are provided such that they are spaced apart from each other in storage compartment 22. For example, camera 500 may be provided in the upper portion of inner case 12 in order to get a complete image of the interior of storage compartment 22. However, light source 400 may be provided at a position other than the upper portion of inner case 12 in order to illuminate the entire area in storage compartment 22.

When camera 500 and light source 400 are provided such that they are spaced apart from each other, there may be various problems related to space utilization or wiring when connecting camera 500 and light source 400 via wires. Accordingly, this embodiment discloses a method in which camera 500 gets an image related to the flickering of light source 400, the image is converted into data, and the data is transmitted.

Figure 4:
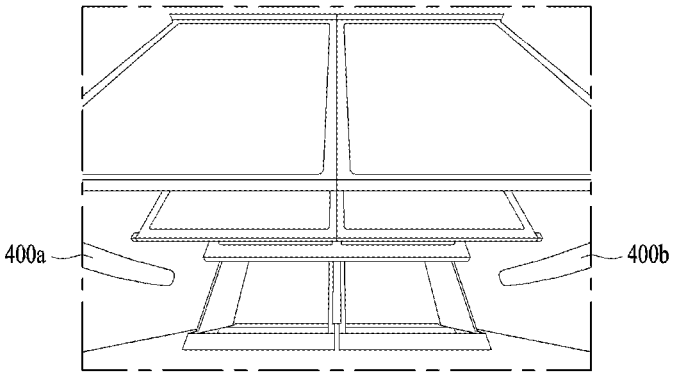
FIG. 4 is a view for explaining an image captured by a camera.

As shown in FIG. 4, light source 400 may include a first light source 400*a* and a second light source 400*b*. The camera 500 may capture an image including both first light source 400*a* and second light source 400*b*.

The first light source 400*a* may be disposed in the left portion of storage compartment 22, and second light source 400*b* may be disposed in the right portion of storage compartment 22. That is, in a single image captured by camera 500, the captured position of first light source 400*a* and the captured position of second light source 400*b* may be different.

The second converting unit 550 may distinguish between the captured portion of first light source 400*a* and the captured portion of second light source 400*b* in a single image, may thus distinguish between the flickering of first light source 400*a* and the flickering of second light source 400*b*, and thereby may get respective information therefrom. The second converting unit 550 may convert the respective information related to first light source 400*a* and second light source 400*b* into separate data related thereto. That is, it is possible to get data transmitted through two light sources 400 from a single image captured by camera 500.

Of course, camera 500 may be disposed such that three or more light sources can appear in a single image, whereby three or more pieces of information can be transmitted through camera 500.

The sensor connected to first light source 400*a* via wires and the sensor connected to the second light source 400*b* via wires may be different from each other. For example, first light source 400*a* may transmit temperature information measured by the temperature sensor, and second light source 400*b* may transmit humidity information measured by the humidity sensor. In this case, first light source 400*a* and second light source 400*b* may be provided with different respective first converting units, and the data converted by the respective first converting units may be separately transmitted through first light source 400*a* and second light source 400*b*.

Figure 5:
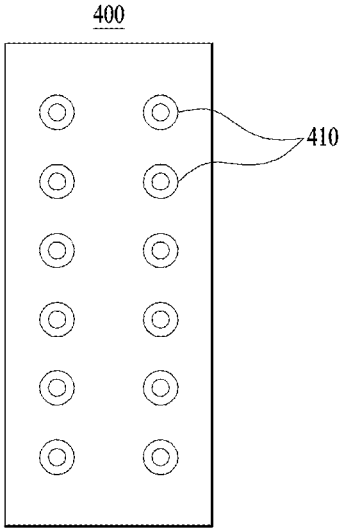
FIG. 5 is a view for explaining a light source.

FIG. 5 is a view of the light source of the refrigerator according to an embodiment of the present disclosure.

Referring to FIG. 5, a plurality of LEDs 410 may be used in a single light source. Therefore, the intensity of illumination of a single light source 400 may be adjusted by selectively turning each of the LEDs 410 on. That is, light source 400 may include a plurality of LEDs 410, and the intensity of illumination of light source 400 may be changed by varying the number of LEDs 410 that are turned on.

The first converting unit 250 may also perform data processing, which makes it possible to transmit information based on the intensity of illumination of light source 400 as well as the flickering of light source 400. If the information is transmitted to camera 500 using the flickering and the change of intensity of illumination of light source 400, more information may be transmitted in a short time in comparison with the structure using only the flickering of light source 400. This is possible because the reception component that receives information from light source 400 is the camera that captures an image.

As is apparent from the above description, the present disclosure provides a refrigerator and a method for controlling the same, in which information sensed by a sensor may not be transmitted through wires, thereby improving the efficiency of space usage in a storage compartment without the necessity of additional wiring in the refrigerator.

Further, since information sensed by a plurality of sensors can be transmitted at the same time, it is possible to get the information in a short time.

It will be apparent to those skilled in the art that various modifications and variations can be made in the present disclosure without departing from the spirit or scope of the invention. Thus, it is intended that the present disclosure covers the modifications and variations of this invention provided they come within the scope of the appended claims and their equivalents.

What is claimed is:

1. A method for controlling a refrigerator including a cabinet having a storage compartment, a door configured to open and close the storage compartment, a sensor provided in the cabinet to measure information related to an internal state of the refrigerator, a light source configured to emit light to the storage compartment when the door is in a closed position, a camera configured to successively capture images of the light source in the storage compartment, wherein the sensor is configured to transmit the sensed information corresponding to the internal state of the storage compartment, wherein a first converting unit is configured to convert the sensed information into a digital signal that is to be transmitted through the light source and cause the light source to flicker thereby creating a flicker signal, wherein a second converting unit is configured to convert the flicker signal of the light source into the digital signal corresponding thereto, wherein an operation of the refrigerator is controlled based on the digital signal corresponding to the sensed information that is converted by the second converting unit, wherein the camera and the light source are electrically and physically separate from each other, the method comprising:

determining whether the storage compartment is closed by the door;

upon determining that the storage compartment is closed by the door, obtaining the sensed information related to the internal state of the refrigerator, driving the light source to repeatedly turn on and off according to the digital signal based on the sensed information;

successively capturing images of the flickering light source using the camera;

comparing the images successively captured by the camera to obtain the digital signal;

converting the digital signal into the sensed information; and controlling an operation of the refrigerator based on the sensor information converted from the sensed information.

2. The method of claim 1, further comprising:

upon determining that the door is closed, converting the first information into the digital signal using the first converting unit.

3. The method of claim 2, wherein the first information is transmitted to the first converting unit through wires, and the light source connected to the first converting unit via wires is driven to flicker corresponding to the first information converted by the first converting unit.

4. The method of claim 1, wherein the image captured by the camera is transmitted to the second converting unit through wires, the second converting unit being different than the first converting unit.

5. The method of claim 1, further comprising:

upon determining that the door has been closed for a predetermined time, converting the first information sensed by the sensor into the flicker signal to be transmitted through the light source using the first converting unit.

6. The method of claim 1, wherein:

upon determining that the door is not closed, driving the light source to provide light to an interior of the storage compartment.

7. The method of claim 1, wherein whether the door is closed is sensed by a door switch sensor.

8. A method for controlling a refrigerator including a cabinet having a storage compartment, a door configured to open and close the storage compartment, a sensor provided in the cabinet to measure and transmit information related to an internal state of the refrigerator, the information being a temperature or humidity level of the inside of the refrigerator, a light source to emit light to the storage compartment when the door is in a closed position, the light source comprising a plurality of LEDs so that the intensity of illumination of the light source and flickering of the light source are adjustable by selectively turning each of the LEDs on and off, and a camera to successively capture images of the light source in the storage compartment, wherein the camera and the light source are electrically and physically separate from each other, the method comprising:

determining, by a door sensor, whether the storage compartment is closed by the door;

upon determining that the storage compartment is closed by the door, obtaining the sensed information, from the sensor, related to the internal state of the refrigerator;

converting the sensed information into a digital signal corresponding to the sensed information when the sensed information exceeds a predetermined range;

transmitting the digital signal through the light source;

driving the light source to flicker according to the digital signal, whereby the time interval of the flickering varies according to the sensed information;

successively capturing images of the flickering light source using the camera;

comparing the images successively captured by the camera in temporal order to obtain the sensed information from the intensity of illumination of the light source and flickering of the light source; and controlling an operation of the refrigerator based on the sensed information obtained from the image comparisons.

* * * * *